US006435829B1

(12) United States Patent
Meng et al.

(10) Patent No.: US 6,435,829 B1
(45) Date of Patent: Aug. 20, 2002

(54) HIGH SUCTION PERFORMANCE AND LOW COST INDUCER DESIGN BLADE GEOMETRY

(75) Inventors: Sen Yih Meng, Reseda; George H. Prueger, Simi Valley; Wei-Chung Chen, Westlake Village, all of CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/497,578

(22) Filed: Feb. 3, 2000

(51) Int. Cl.[7] ..... F04D 29/38
(52) U.S. Cl. ..... 416/176; 416/233 R; 416/234
(58) Field of Search ..... 416/176, 177, 416/223 R, 234; 415/71, 73, 76, 119, 914, 227

(56) References Cited

U.S. PATENT DOCUMENTS 3,299,821 A * 1/1967 Silvern ..... 416/176 X
3,442,220 A 5/1969 Mottram et al. ..... 416/176 X
3,737,249 A * 6/1973 Cooper ..... 416/176 X
4,552,511 A * 11/1985 Sumigawa ..... 416/242
4,789,306 A * 12/1988 Vorus et al. ..... 416/223 R
4,795,312 A 1/1989 Purcaru
4,921,404 A * 5/1990 Holmberg ..... 416/223 R
5,100,295 A 3/1992 Madden
5,114,313 A * 5/1992 Vorus ..... 416/93 A
5,139,391 A * 8/1992 Carrouset ..... 416/177 X
5,167,489 A 12/1992 Wadia et al.
5,192,193 A 3/1993 Cooper et al. ..... 416/186 R
5,478,200 A 12/1995 Brodersen et al.
5,997,242 A * 12/1999 Hecker et al. ..... 416/177 X
6,343,909 B1 * 2/2002 Springer et al. ..... 416/176 X

* cited by examiner

*Primary Examiner*—John E. Ryznic
(74) *Attorney, Agent, or Firm*—Harness Dickey & Pierce P.L.C.

(57) ABSTRACT

An inducer having a hub and a plurality of blades is provided. In one embodiment, the thickness of the blades is defined such that during the operation of the inducer each of the blades is positioned underneath a cavitation vapor line so as to improve the performance of the inducer. In another embodiment, the hub is contoured or ramped according to a fifth order polynomial to provide improved performance. In another embodiment, the flow passage area of the inducer, as taken normal to the flow of fluid, is varied according to a fifth order polynomial to provide improved performance.

27 Claims, 8 Drawing Sheets

HIGH SUCTION PERFORMANCE AND LOW COST INDUCER DESIGN BLADE GEOMETRY

TECHNICAL FIELD

The present invention relates generally to pumps and more particularly to the geometry of the inducer blades of a pump to improve performance and prevent cavitation damage.

BACKGROUND OF THE INVENTION

Background Art

As is well known in the art, inducer blade design is a compromise between various considerations for performance, structural integrity and manufacturability. For example, in considering the aspects of an inducer to arrive at maximum performance, the inducer blade thickness ideally approaches zero. Unfortunately, construction in this manner is extremely difficult and severely compromises the structural integrity of the inducer. In considering the aspects of structural integrity, a large inducer blade thickness is preferable. However, construction in this manner results in an inducer with extremely poor performance. In considering the aspects which affect the ease with which an inducer may be manufactured, it is highly desirable to simplify the geometry of the inducer blade using a single angle to define the cant of the blade.

SUMMARY OF THE INVENTION

It is one object of the present invention to provide a simplified inducer blade design which may be more easily manufactured but which has a high degree of structural integrity and provides improved performance.

It is another object of the present invention to provide an inducer having a plurality of blades whose thickness does not exceed the height of a cavitation cavity.

It is a further object of the present invention to provide an inducer having a hub which is ramped according to a fifth order polynomial.

It is yet another object of the present invention to provide an inducer whose flow passage area as taken normal to the flow of fluid varies according to a fifth order polynomial.

In one form, the present invention provides an inducer having a hub and a plurality of blades with the thickness of the blades being defined such that during the operation of the inducer each of the blades is positioned underneath a cavitation vapor line so as to improve the performance of the inducer. In another form, the present invention provides an inducer with a hub that is contoured or ramped according to a fifth order polynomial to provide improved performance. In still another form, the present invention provides an inducer having a flow passage area, as taken normal to the flow of fluid, which varies according to a fifth order polynomial to provide improved performance.

BRIEF DESCRIPTION OF THE DRAWINGS

Additional advantages and features of the present invention will become apparent from the subsequent description and the appended claims, taken in conjunction with the accompanying drawings, wherein:

FIG. 3 is a plot of the cavitation cavity height and blade thickness along a streamline adjacent the inducer hub;

DETAILED DESCRIPTION OF THE PREFERRED EMBODIMENT

Figure 1:
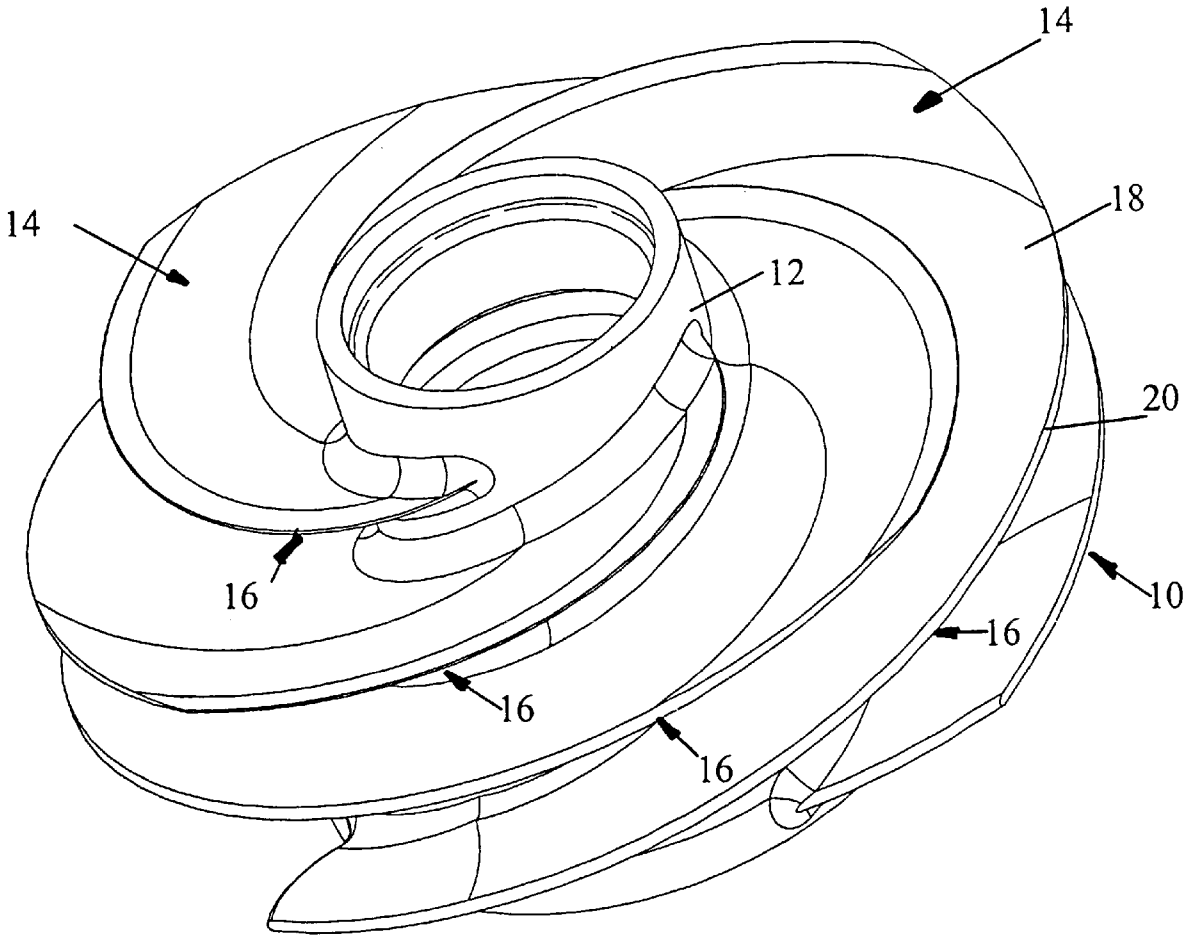
FIG. 1 is a perspective view of an inducer constructed in accordance with the teachings of the present invention.

With reference to FIG. 1 of the drawings, an inducer constructed in accordance with the teachings of the present invention is generally indicated by reference numeral 10. With brief reference to FIG. 6, inducer 10 is shown to cooperate with housing 11*a* to form a pump 11. Returning to FIG. 1, inducer 10 is shown to include a hub portion 12 and a plurality of blades 14 which cooperate to define a plurality of flow passages 16. Each of the plurality of blades 14 includes a suction side 18 and a pressure side 20. The cant angle of the pressure side 20 of the blade 14 is illustrated to be constant to render inducer 10 easier to manufacture and reduce machining costs.

Figure 2:
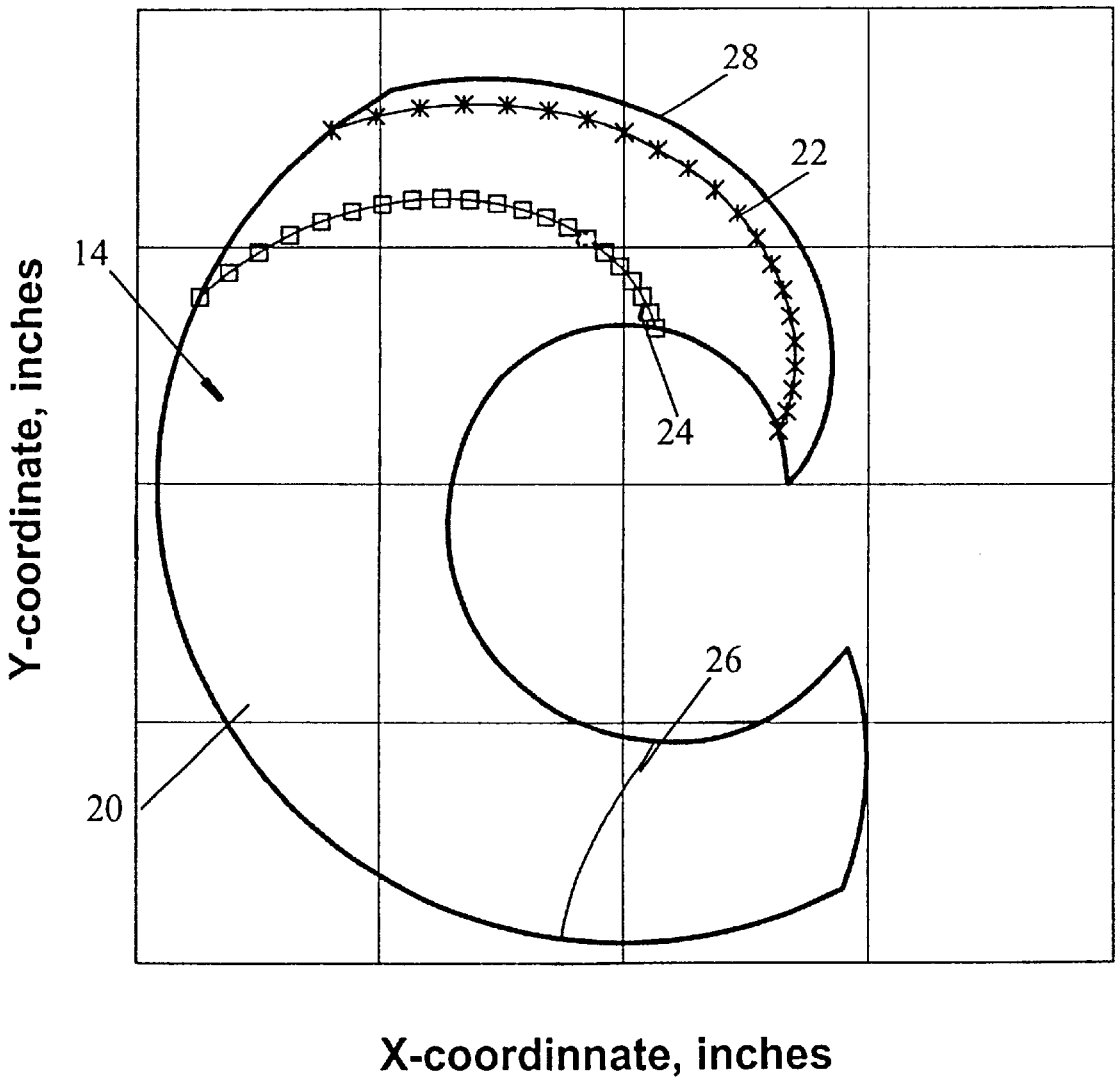
FIG. 2 is a plot of the blade of the inducer of FIG. 1.
Figure 2:
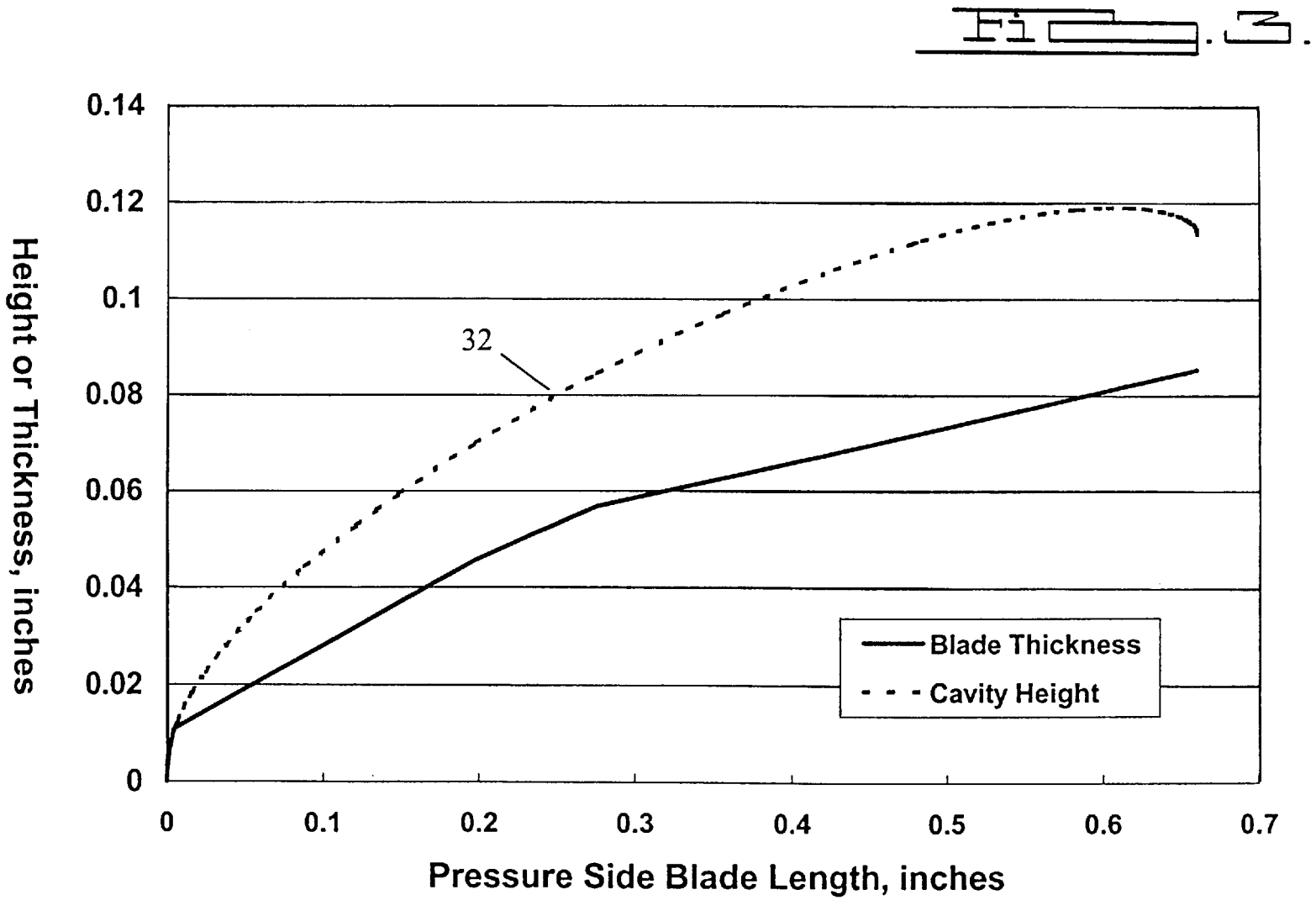

FIG. 2 shows a polar plot of four distinct regions on the suction side 18 of inducer 10. Each region is defined by a constant cant angle which improves the ease with which inducer 10 may be manufactured. The suction side 18 includes a plurality of fairing blend lines (22, 24, 26) between each of the regions.

In designing blade 14, the thickness of the blade 14 in the area between the leading edge 28 of the blade and the second fairing blend line 24 is controlled so that the blade 14 does not extend beyond a cavitation vapor line for a predetermined flow incidence angle. The cavitation vapor line defines the maximum blade thickness for the predetermined flow incidence angle.

In the region between the leading edge 28 of the blade 14 and the first fairing blend line 22, the blade thickness is designed to counter the stress loading produced by high fluid pressures at the leading edge 28 while remaining below the cavitation vapor line. In the region between the second and third fairing blend lines 24 and 26, the blade thickness distribution is controlled to produce no diffusion and constant relative velocity.

Figure 4:
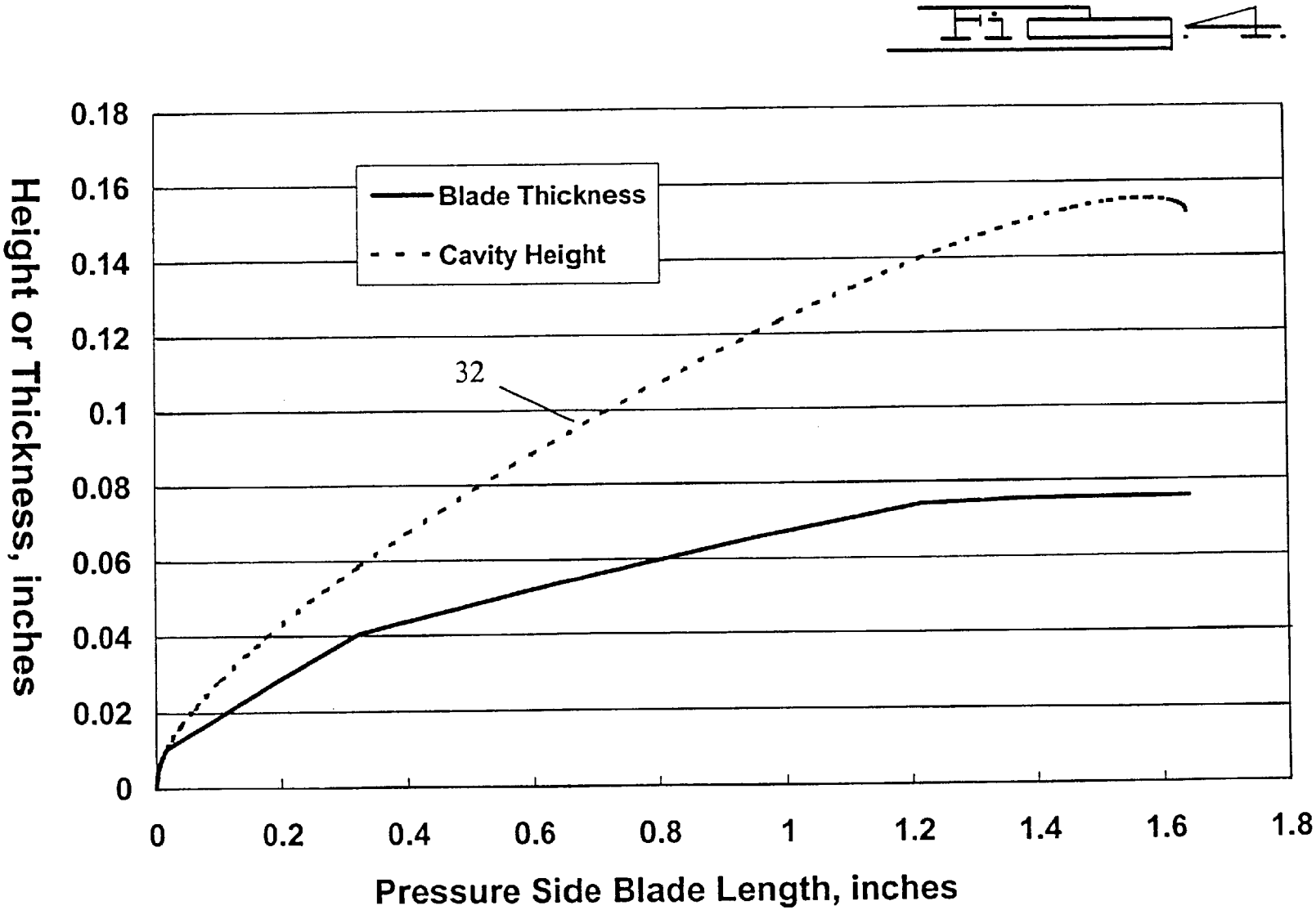
FIG. 4 is a plot of the cavitation cavity height and blade thickness along a mean streamline.
Figure 5:
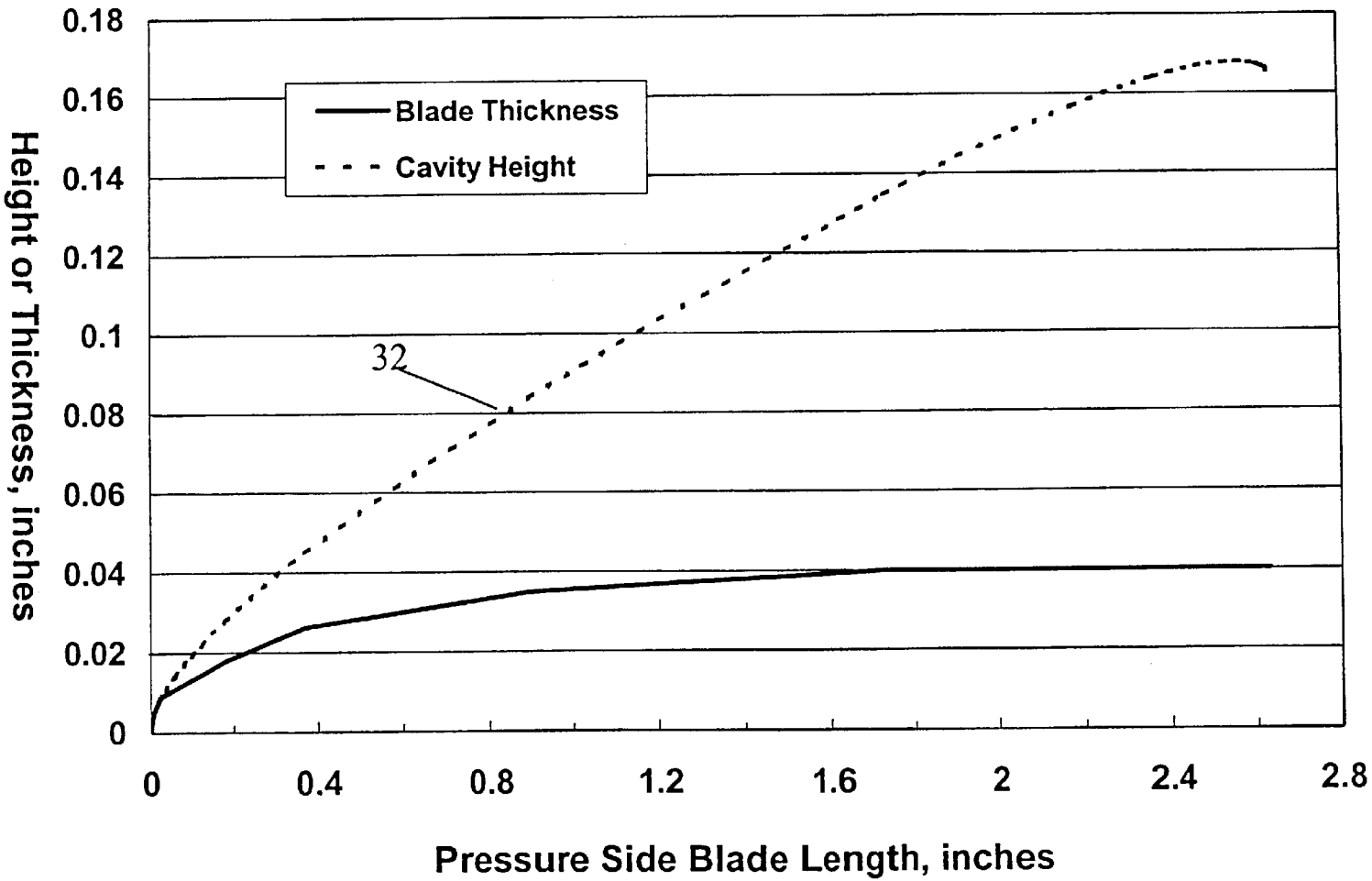
FIG. 5 is a plot of the cavitation cavity height and blade thickness along a streamline adjacent the tip.

In FIGS. 3 through 5, the thickness of blade 14 and the cavitation cavity is illustrated along various streamlines. As mentioned above, the predictions of the cavitation vapor line 32 are used to define the maximum blade thickness allowed for a given flow incidence angle at the leading edge 28 of blade 14. FIG. 3 illustrates the height of the cavitation cavity and the thickness of the blade 14 along a streamline nearest to hub 12. FIG. 4 illustrates the height of the cavitation cavity and the thickness of the blade 14 along a mean streamline. FIG. 5 illustrates the height of the cavitation cavity and the thickness of the blade 14 along a streamline at the tip of the blade 14. Note that in all cases the blade thickness is controlled such that the blade remains within the cavitation cavity. In so doing, blade passage blockage is minimized, permitting higher suction performance.

Figure 6:
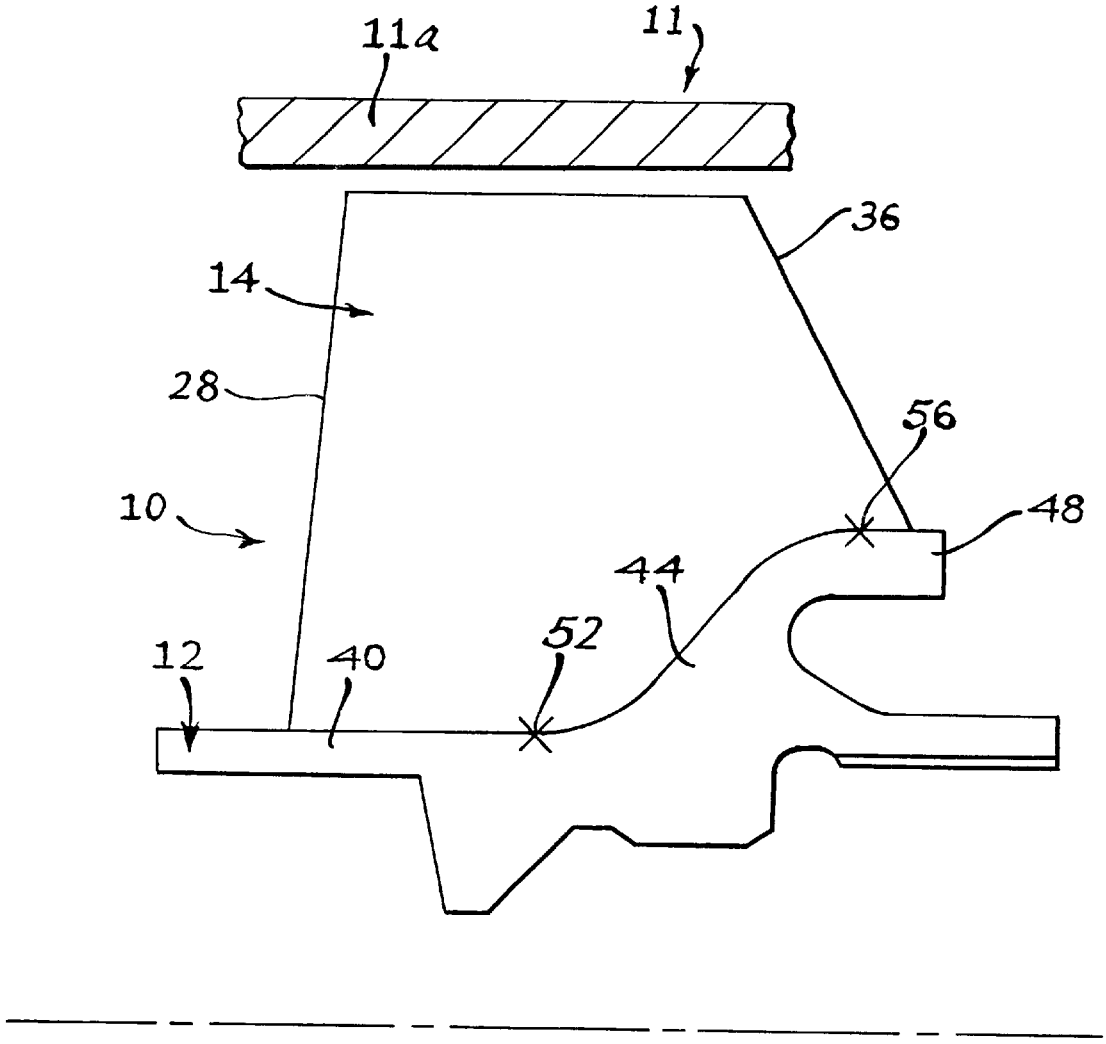
FIG. 6 is a longitudinal cross-section of the inducer of FIG. 1 illustrating the variation in the hub contour.
Figure 7:
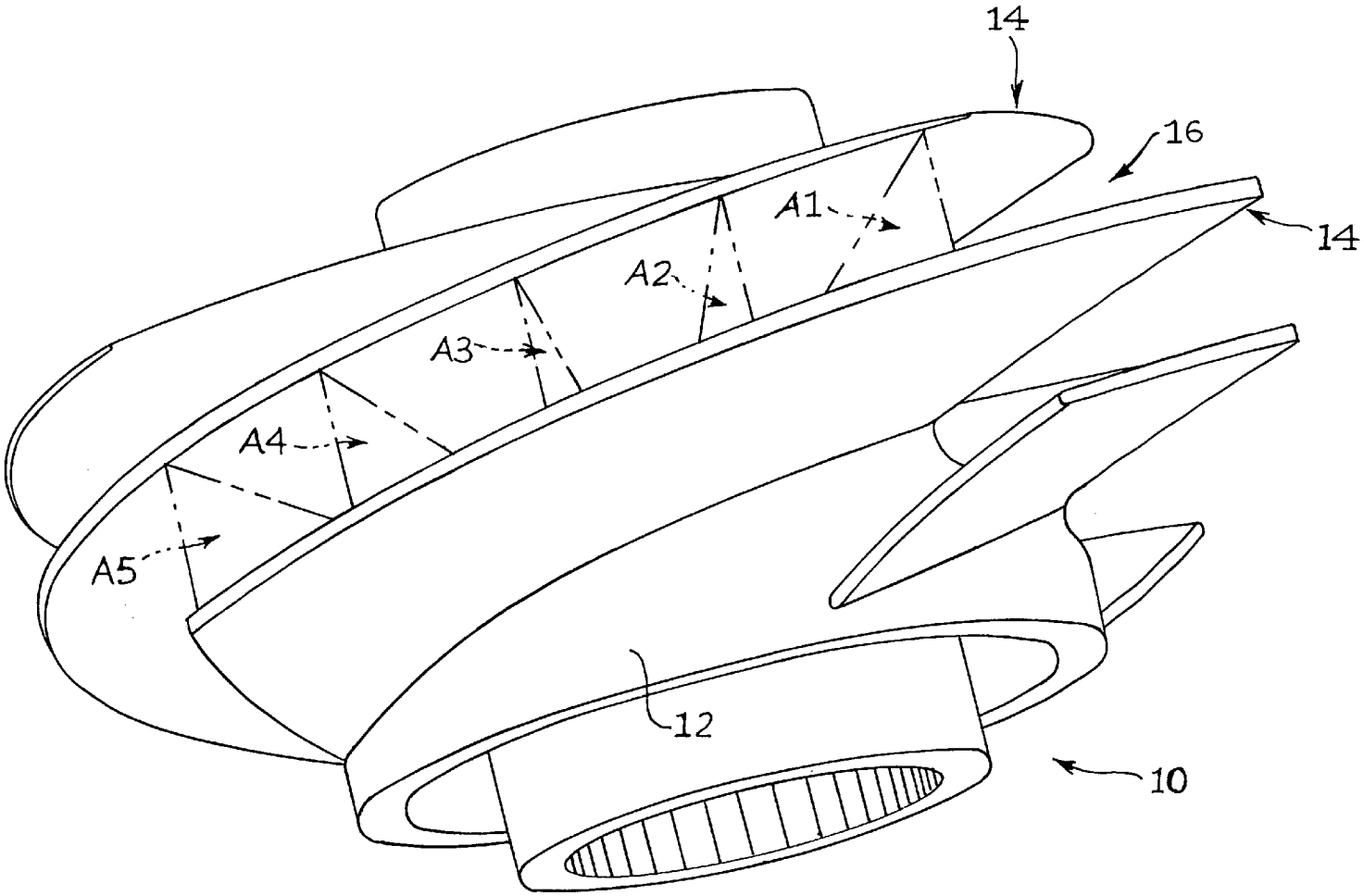
FIG. 7 is a perspective view similar to that of FIG. 1 illustrating the area distributions of the flow passages.
Figure 8:
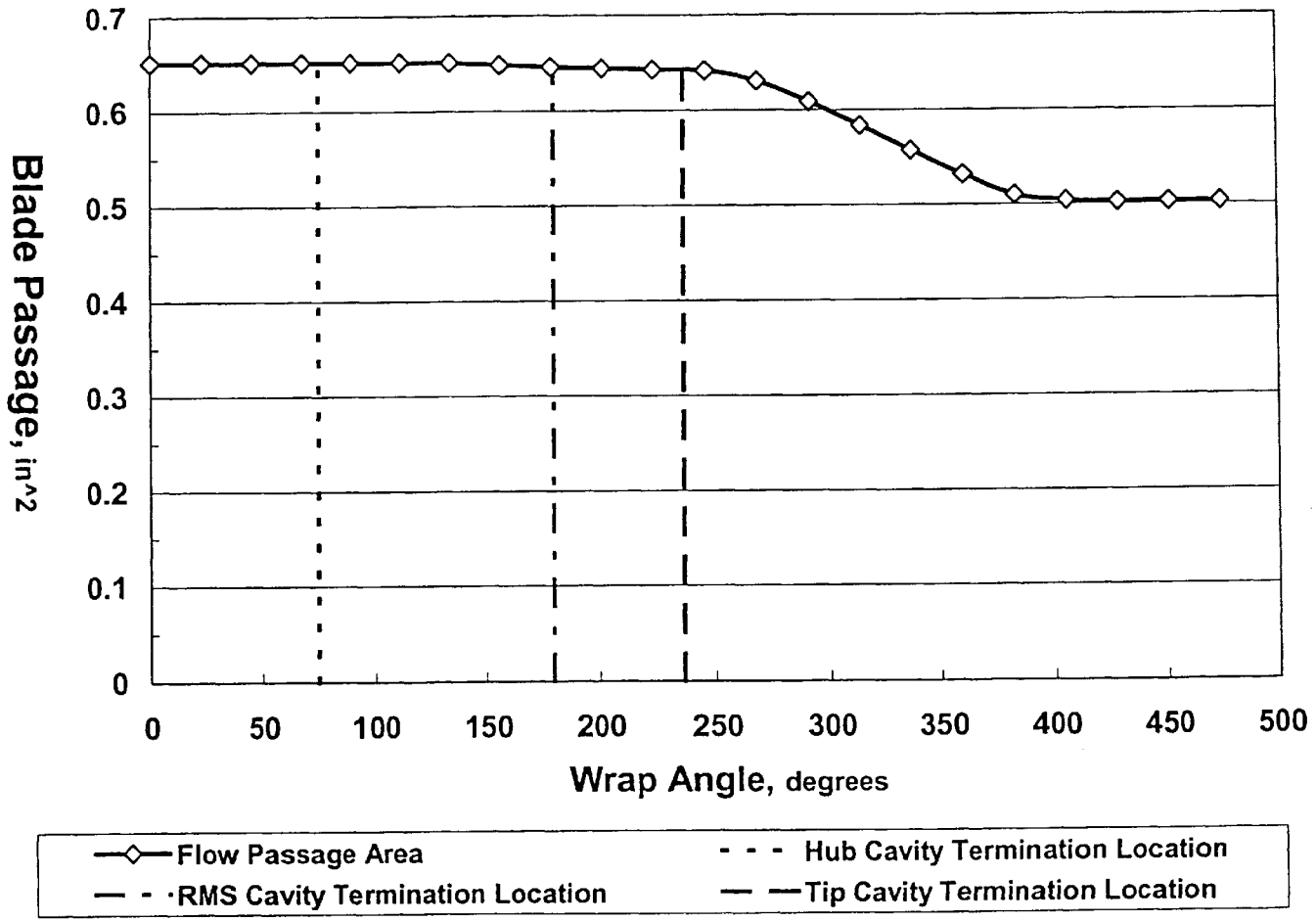
FIG. 8 is an exemplary plot of the flow passage area distribution indicating various relationships with respect to the cavity termination locations.

FIGS. 6, 7 and 8 illustrate another aspect of the present invention, namely the control of the angular variation of the blades 14 and the ramp of the hub 12 to maintain a flow passage 16 having a constant area before the cavity termination. As shown in FIG. 7, the area of the flow passages 16 is taken normal to the flow of fluid through the inducer 10, as indicated by areas A1, A2, A3, A4 and A5. The area of flow passages 16 as taken normal to the flow of fluid through the inducer 10 preferably varies in a manner similar to that shown in FIG. 8. Construction in this manner minimizes the length of the cavitation cavity and improves the performance of the inducer 10.

The blade normal area at the constant pressure side cant line is preferably controlled pursuant to equation (1):

$$A_x=2\times\pi\times r_t^2\times\tan(\beta_x)\times\{\mathrm{sqrt}[1+\tan^2(\beta_x)]+\mathrm{sqrt}[{}_x^2+\tan^2(\beta_x)]\}$$

where:

- $A_x$ is the normal blade area at any predetermined location x, where x is the axial distance from the tip of the leading edge;
- $r_t$ is the inducer tip radius;
- $\beta_x$ is the tip blade angle at a predetermined location x, where x is the axial distance from the tip of the leading edge;
- sqrt is the square root of the indicated quantity;
- tan is the trigonomic tangent function of the indicated quantity; and
- $h_x$ is the hub and tip radius ratio as a function of x, where x is the axial distance from the tip of the leading edge.

The tangential blade angle distribution extended from any constant cant line at any x is preferably controlled pursuant to equation (2):

$$r\times\tan(\beta_r)=r_t\times\tan(\beta_x)$$

Where:

- r is any radius along the constant cant line extended from the tip;
- $\beta_r$ is the tangential blade angle at any radius on the constant cant line;
- $r_t$ is the inducer tip radius; and
- $\beta_x$ is the tip blade angle at a predetermined location x, where x is the axial distance from the tip of the leading edge.

The normalized blade passage normal area variation is preferably controlled pursuant to equations (3), (4) and (5):

$$AR_x=1 \qquad \text{Equation (3)}$$

$$AR_x=1+(AR-1)\times(10-15\times y+6\times y^2)\times y^3 \qquad \text{Equation (4)}$$

$$y=(X-X_{tm})/(X_t-X_{tm}) \qquad \text{Equation (5)}$$

where:

- $AR_x$ is the normalized blade passage normal area at any predetermined location x, where x is the axial distance from the tip of the leading edge;
- AR is the area ratio at the inducer tip leading and trailing edge location (final area); once AR is determined,
- y is an intermediate variable defined by Equation 5;
- X is the axial distance from the tip of the leading edge;
- $X_t$ is the inducer tip trailing edge distance from the inducer tip leading edge; and
- $X_{tm}$ is the distance for tip cavity termination location from the inducer tip leading edge.

Equation (3) is employed to calculate the normalized blade passage normal area in situations where (X) is less than or equal to ($X_{tm}$). Equation (3) is designed to closely simulate a Stripling-Acosta flat plate (constant blade area) cavitation model to optimize the suction performance of the inducer 10. Equation (4) is employed to calculate the normalized blade passage normal area in situations where (X) is greater than ($X_{tm}$). Equation (5) is employed to calculate the intermediate variable (y) used in Equation (4).

The hub 12 includes a first portion 40, a second portion 44 and a third portion 48. The first portion 40 has a constant radius and terminates at the constant tip leading edge cant line intercept point 52 shown in FIG. 6. The radius of the second portion 44 is defined by a smooth function governing the degree of increase from leading edge cant line intercept point 52 and the trailing edge cant line intercept point 56. The second portion 44 terminates at the trailing edge cant line intercept point 56. The third portion 48 begins at the trailing edge cant line intercept point 56 and has a constant radius.

The radius of the second portion 44 may be produced according to a fifth order polynomial to define the hub profile, an example of which is provided by equations (6) and (7):

$$r_h=r_{h1}+(r_{h2}-r_{h1})\times(10-15\times Z+6\times Z^2)\times z^3 \qquad \text{Equation (6)}$$

$$X_h=X+(r_t-r_h)\times\tan(\beta_{cant}) \qquad \text{Equation (7)}$$

where:

- $r_h$ is the radius of the hub at a predetermined point in the second portion 44;
- $r_{h1}$ is the radius of the hub at the first portion 40;
- $r_{h2}$ is the radius of the hub at the third portion 48;
- Z is an intermediate variable equaling the quantity of $X/X_t$;
- X is the axial distance from the tip of the leading edge;
- $X_t$ is the inducer tip trailing edge distance from the inducer tip leading edge;
- $X_h$ is the hub axial location;
- $r_t$ is the is the inducer tip radius; and
- $\beta_{cant}$ is the pressure cant angle.

Note that the fifth order polynomial has first and second derivatives equal to zero at the leading edge cant line intercept point 52 and the trailing edge cant line intercept point 56. By employing equations (6) and (7), the blade angle distributions can be defined through equations (1) through (5).

The radius of the second portion 44 may also be produced by with a fifth order polynomial to define the tip tangential blade angle, such as the one provided in equation (8):

$$\beta_x=\beta_1+(\beta_2-\beta_1)\times(10-15\times Z+6\times Z^2)\times Z^3$$

where:

- $\beta_x$ is the tip tangential blade angle at a predetermined location x;
- $\beta_1$ is the tip tangential blade angle at the leading edge;
- $\beta_2$ is the tip tangential blade angle at the trailing edge;
- Z is an intermediate variable equaling the quantity of $X/X_t$;
- X is the axial distance from the tip of the leading edge; and
- $X_t$ is the inducer tip trailing edge distance from the inducer tip leading edge.

Construction of inducer 10 in a manner which incorporates the above equations provides a gradually increasing tip discharge tangential angle which causes the final area of the flow passage 16 and the area of blade 14 to provide the desired blade area ratio (AR). Designing the inducer discharge blade angle closer to the area ratio (AR) yields a discharge area that provides the design or target inducer head.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. An inducer for a pump, the inducer comprising a hub and a plurality of blades coupled thereto, the thickness of the blades being defined such that during operation of the pump, each of the blades is positioned underneath a cavitation vapor line.

2. The inducer of claim 1, wherein the cavitation vapor line defines a maximum blade thickness for a predetermined flow incidence angle at a leading edge of the blades.

3. The inducer of claim 1, wherein each of the blades includes a pressure side and a suction side, a portion of each of the suction sides being defined by a constant cant angle.

4. The inducer of claim 3, wherein each suction side includes a first fairing blend line formed between a first cant angle and a second cant angle, a second fairing blend line formed between the second cant angle and a third cant angle, and a third fairing blend line formed between the third cant angle and a fourth cant angle.

5. The inducer of claim 4, wherein the thickness of a portion of the blades between a leading edge and the first fairing blend line is designed to counter stress loading produced by a fluid pressure at the leading edge.

6. The inducer of claim 4, wherein the thickness of a portion of the blades between the second and third fairing blend lines is controlled to have no diffusion and constant relative velocity.

7. The inducer of claim 3, wherein at least a portion of each of the pressure sides are defined by a constant cant angle.

8. The inducer of claim 1, wherein the profile of at least a portion of the hub conforms to a fifth order polynomial.

9. The inducer of claim 8, wherein the fifth order polynomial has first and second derivatives equal to zero at a first point equal to predetermined first distance from the intersection between the leading edge of one of the blades and the hub.

10. The inducer of claim 9, wherein the predetermined first distance is equal to a fillet radius between the hub and the blade.

11. The inducer of claim 9, wherein the fifth order polynomial has first and second derivatives equal to zero at a second point equal to a predetermined second distance from the intersection between the trailing edge of one of the blades and the hub.

12. The inducer of claim 11, wherein the predetermined second distance is equal to a fillet radius between the hub and the blade.

13. The inducer of claim 1, wherein the hub and the plurality of blades cooperate to form a plurality of flow passages, each flow passage having an flow area perpendicular to the flow of a fluid through the inducer, wherein at least a portion of each flow area conforms to a fifth order polynomial.

14. The inducer of claim 13, wherein a second portion of each flow area is constant.

15. The inducer of claim 14, wherein the second portion of each flow area terminates at a tip cavity termination location.

16. A pump comprising an inducer with a hub and a plurality of blades coupled thereto, the thickness of the blades being defined such that during operation of the pump each of the blades is positioned underneath a cavitation vapor line, the hub and the plurality of blades cooperating to form a plurality of flow passages, each flow passage having a constant area.

17. The pump of claim 16, wherein the profile of at least a portion of the hub conforms to a fifth order polynomial, the fifth order polynomial having first and second derivatives equal to zero at a first point equal to predetermined first distance from the intersection between the leading edge of one of the blades and the hub, the fifth order polynomial also having first and second derivatives equal to zero at a second point equal to a predetermined second distance from the intersection between the trailing edge of one of the blades and the hub.

18. The pump of claim 17, wherein the predetermined first and second distances are equal to a fillet radius between the hub and the blade.

19. The pump of claim 16, wherein the cavitation vapor line defines a maximum blade thickness for a predetermined flow incidence angle at a leading edge of the blades.

20. The pump of claim 16, wherein each of the blades includes a pressure side and a suction side, a portion of each of the suction sides being defined by a constant cant angle.

21. The pump of claim 20, wherein each suction side includes a first fairing blend line formed between a first cant angle and a second cant angle, a second fairing blend line formed between the second cant angle and a third cant angle, and a third fairing blend line formed between the third cant angle and a fourth cant angle.

22. The pump of claim 21, wherein the thickness of a portion of the blades between a leading edge and the first fairing blend line is designed to counter stress loading produced by a fluid pressure at the leading edge.

23. The pump of claim 21, wherein the thickness of a portion of the blades between the second and third fairing blend lines is controlled to have no diffusion and constant relative velocity.

24. The pump of claim 16, wherein the profile of at least a portion of the hub is conforms to a fifth order polynomial which defines a tip tangential blade angle.

25. The pump of claim 16, wherein the hub and the plurality of blades cooperate to form a plurality of flow passages, each flow passage having an flow area perpendicular to the flow of a fluid through the inducer, wherein at least a portion of each flow area conforms to a fifth order polynomial.

26. The pump of claim 25, wherein a second portion of each flow area is constant.

27. The pump of claim 26, wherein the second portion of each flow area terminates at a tip cavity termination location.

* * * * *

UNITED STATES PATENT AND TRADEMARK OFFICE

CERTIFICATE OF CORRECTION

PATENT NO. : 6,435,829 B1
DATED : August 20, 2002
INVENTOR(S) : Meng et al.

It is certified that error appears in the above-identified patent and that said Letters Patent is hereby corrected as shown below:

Drawings,
Sheet 2, Figure 8 at the bottom of the drawing "X-coordinnate, inches" should read -- X-coordinate, inches --

Column 4,
Line 38, remove second occurrence of "is" after "the".

Column 6,
Line 3, remove "an" and insert -- a --.
Line 53, remove "is".
Line 57, remove "an" and insert -- a --.

Signed and Sealed this

Thirteenth Day of May, 2003

JAMES E. ROGAN
*Director of the United States Patent and Trademark Office*